US011377773B2

(12) United States Patent
Park et al.

(10) Patent No.: US 11,377,773 B2
(45) Date of Patent: Jul. 5, 2022

(54) WASHING MACHINE

(71) Applicant: SAMSUNG ELECTRONICS CO., LTD., Suwon-si (KR)

(72) Inventors: Nae Young Park, Seoul (KR); Jong-Hun Sung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 55 days.

(21) Appl. No.: 16/640,920

(22) PCT Filed: Aug. 8, 2018

(86) PCT No.: PCT/KR2018/009024
§ 371 (c)(1),
(2) Date: Feb. 21, 2020

(87) PCT Pub. No.: WO2019/039775
PCT Pub. Date: Feb. 28, 2019

(65) Prior Publication Data

US 2021/0131012 A1 May 6, 2021

(30) Foreign Application Priority Data

Aug. 21, 2017 (KR) ..... 10-2017-0105678

(51) Int. Cl.
*D06F 37/26* (2006.01)
*D06F 39/08* (2006.01)
*D06F 37/28* (2006.01)

(52) U.S. Cl.
CPC ..... *D06F 37/267* (2013.01); *D06F 39/081* (2013.01); *D06F 39/083* (2013.01); *D06F 37/28* (2013.01)

(58) Field of Classification Search
CPC ..... D06F 37/267; D06F 39/081; D06F 39/083
See application file for complete search history.

(56) References Cited

U.S. PATENT DOCUMENTS 4,247,158 A * 1/1981 Quayle ..... A47L 15/488 134/200
5,558,244 A 9/1996 Akaike et al.
2004/0107993 A1* 6/2004 Stephens ..... F16K 24/06 137/217

(Continued)

FOREIGN PATENT DOCUMENTS

DE 29724890 U1 5/2005
DE 102011087645 A1 6/2013

(Continued)

OTHER PUBLICATIONS

International Search Report dated Nov. 16, 2018 from International Patent Application PCT/KR2018/009024, 5 pages.

(Continued)

*Primary Examiner* — Joseph L. Perrin
(74) *Attorney, Agent, or Firm* — Staas & Halsey LLP

(57) ABSTRACT

A washing machine having a plurality of washing apparatuses is provided. The washing machine includes a tub, a drum rotatably disposed inside the tub, a discharge member provided in the tub to discharge air in the drum to the outside of the tub, and a cap coupled to the discharge member to prevent water in the drum from being discharged to the outside of the tub through the discharge member.

12 Claims, 12 Drawing Sheets

(56) References Cited

U.S. PATENT DOCUMENTS

| | | | | |
|---|---|---|---|---|
| 2011/0296879 | A1* | 12/2011 | Seo | D06F 37/262 68/23 R |
| 2015/0097472 | A1* | 4/2015 | Rockwell | A47L 15/4209 312/228 |
| 2016/0215432 | A1 | 7/2016 | Kim | |
| 2017/0290489 | A1* | 10/2017 | Noriega | A47L 15/4261 |

FOREIGN PATENT DOCUMENTS

| | | | |
|---|---|---|---|
| EP | 1908874 | A2 | 4/2008 |
| EP | 1908874 | A3 | 5/2013 |
| JP | 2003-311091 | | 11/2003 |
| KR | 1998-036483 | | 9/1998 |
| KR | 20-0150797 | | 7/1999 |
| KR | 10-2015-0072169 | | 6/2015 |
| KR | 10-2017-0086795 | | 7/2017 |
| WO | 2006/080800 | A1 | 8/2006 |

OTHER PUBLICATIONS

Samsung Newsroom [online], Jan. 1, 2017, URL:https://news.samsung.com/global/samsung-unveils-laundry-game-changer-at-ces-2017-with-new-four-in-one-laundry-system.

Extended European Search Report dated May 15, 2020 from European Application No. 18849303.5, 7 pages.

Korean Office Action dated Oct. 14, 2021 from Korean Application No. 10-2017-0105678.

* cited by examiner

WASHING MACHINE

CROSS-REFERENCE TO RELATED APPLICATIONS

This application is a U.S. National Stage Application which claims the benefit under 35 U.S.C. § 371 of International Patent Application No. PCT/KR2018/009024 filed on Aug. 8, 2018, which claims foreign priority benefit under 35 U.S.C. § 119 of Korean Patent Application No. 10-2017-0105678 filed on Aug. 21, 2017 in the Korean Intellectual Property Office, the contents of both of which are incorporated herein by reference.

TECHNICAL FIELD

Embodiments of the present disclosure relate to a washing machine, and more particularly, to a washing machine including a plurality of washing apparatuses.

BACKGROUND ART

In general, a washing machine is an apparatus for washing laundry by rotating a cylindrical drum in which the laundry is contained.

Washing machines are classified into a front loading type in which a drum positioned horizontally rotates on a horizontal shaft to raise laundry upward along the inner circumferential surface of the drum and then drop it to thereby wash the laundry.

Washing machines are classified into a top loading type in which a drum having a pulsator and positioned vertically rotates on a vertical shaft to wash laundry by a water current generated by the pulsator.

The front loading type washing machine in which the drum is positioned horizontally was named because a laundry entrance is formed in the front portion, and the top loading type in which the drum is positioned vertically was named because a laundry entrance is formed in the upper portion.

Meanwhile, most of typical washing machines have a single washing apparatus. Therefore, a user who wants to separate clothing when doing the laundry should operate a washing machine two times or more. That is, users had the inconvenience of having to use the washing machine for a long time even when washing a small amount of laundry.

DISCLOSURE

Technical Problem

It is an aspect of the present disclosure to provide a washing machine having a plurality of washing apparatuses.

It is another aspect of the present disclosure to provide a washing machine having a structure for efficiently using an inside space of a housing and improving a user's convenience.

It is another aspect of the present disclosure to provide a washing machine including a door of an improved structure.

It is another aspect of the present disclosure to provide a washing machine including a tub having an improved structure for discharging inside air of the tub to the outside of the tub.

It is another aspect of the present disclosure to provide a washing machine including a tub having an improved structure for preventing water in the tub from being discharged to the outside of the tub.

Technical Solution

In accordance with one aspect of the present disclosure, a washing machine may comprise a tub, a drum rotatably disposed inside the tub, a discharge member provided in the tub to discharge air in the drum to the outside of the tub, and a cap coupled to the discharge member to prevent water in the drum from being discharged to the outside of the tub through the discharge member.

The tub may include a tub body having an open upper portion, and a tub cover configured to cover the open upper portion of the tub body, and the discharge member is disposed in the tub cover.

The tub cover may include a door configured to open or close a laundry inlet, and the discharge member is disposed behind the door to be adjacent to a center of the drum.

The discharge member may include a rib protruding upward from a bottom of the discharge member.

The rib may include an outer rib forming an outer appearance of the discharge member, and an inner rib disposed inside the outer rib and forming a discharge hole communicating with the drum.

The rib may further include a middle rib disposed between the outer rib and the inner rib.

A cross-section area of the discharge hole may be smaller than a cross-section area of a first space provided between the inner rib and the middle rib.

The discharge member may further include a drain hole provided in a bottom of the discharge member to discharge water introduced into the discharge member to the drum.

The drain hole may be disposed between the inner rib and the middle rib.

The middle rib may be cut off to form a slot through which water introduced into a second space formed between the middle rib and the outer rib is discharged to the drain hole.

The cap may include an outer wall forming an outer appearance of the cap and an inner wall disposed inside the outer wall.

A length of the inner wall protruding downward from an upper surface of the cap may be longer than a length of the outer wall protruding downward from the upper surface of the cap.

The inner wall may include a first inner wall protruding downward from an upper surface of the cap and a second inner wall extending downward from the first inner wall to be in contact with a bottom of the discharge member.

The cap may further include an air hole disposed between the outer wall and the inner wall.

The washing machine may further comprise a cover member disposed on a bottom of the discharge member to prevent water from being directly discharged from the drum to the discharge hole.

Advantageous Effects

Since the washing machine according to the present disclosure has a plurality of washing apparatuses, a user may wash laundry separately through the washing machine, as necessary.

The washing machine according to the present disclosure may efficiently use the inside space of the housing, which contributes to an improvement of a user's convenience.

Since the washing machine according to the present disclosure has a door of an improved structure, the gap between the laundry inlet and the door may be sealed.

Since the washing machine according to the present disclosure includes a tub having an improved structure for discharging air inside the tub to the outside of the tub, the inside pressure of the tub may be prevented from rising.

Since the washing machine according to the present disclosure includes a tub having an improved structure, water stored in the tub may be prevented from being discharged to the outside of the tub.

BEST MODE

[Mode for Invention]

Figure 1:
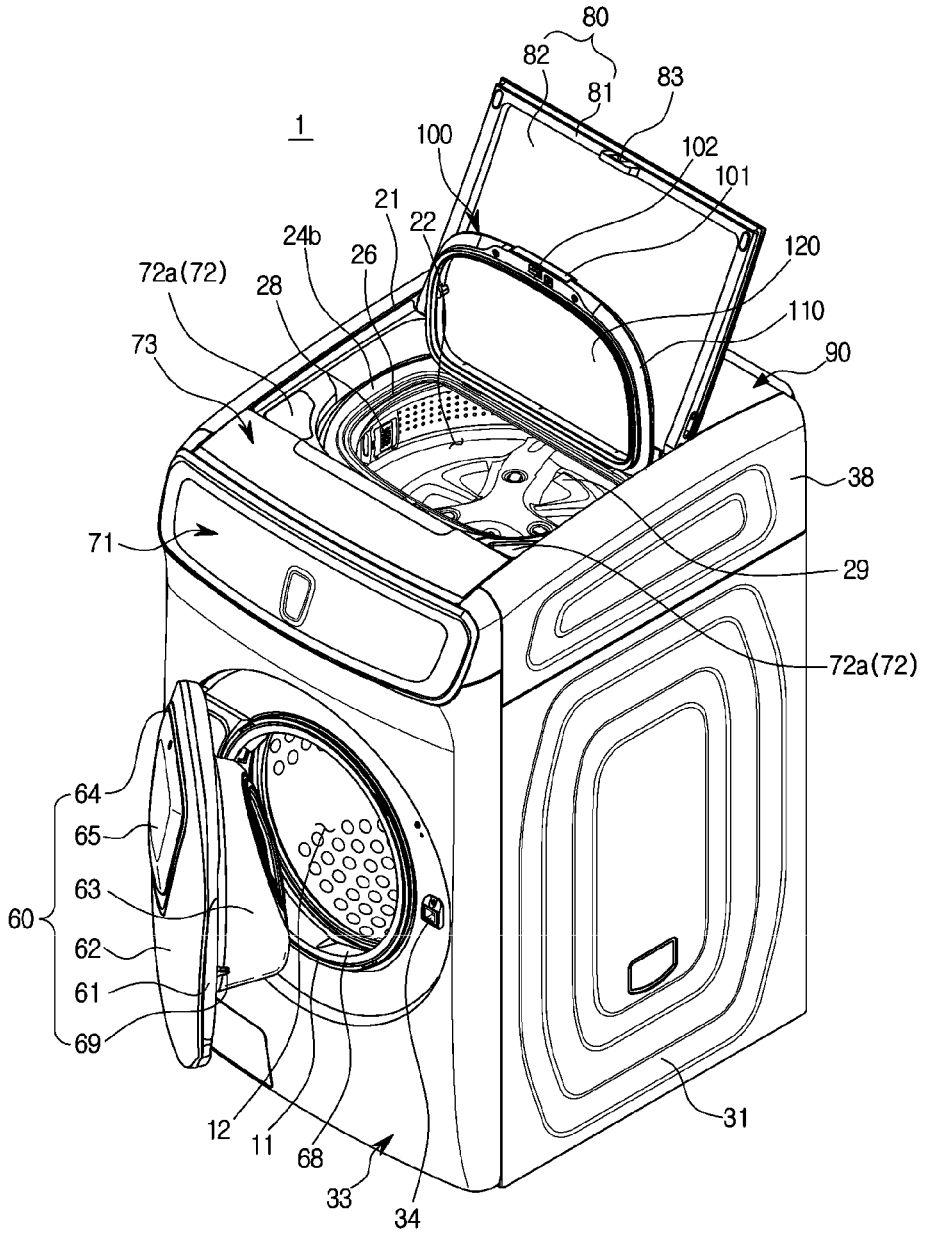
FIG. 1 is a perspective view of a washing machine according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions. The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. It will be understood that the terms "includes," "comprises," "including," and/or "comprising," when used in this specification, specify the presence of stated features, figures, steps, components, or combination thereof.

Therefore, the terms do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another.

For example, a first component could be termed a second component, and, similarly, a second component could be termed a first component, without departing from the scope of the present disclosure.

As used herein, the term "and/or" includes any and all combinations of one or more of associated listed items.

The terms "front", "rear", "upper" and "lower" used in the following description are defined with reference to the drawings, and the shape and position of each component are not limited by these terms.

Hereinafter, the embodiments of the present disclosure will be described in detail with reference to the accompanying drawings.

Figure 2:
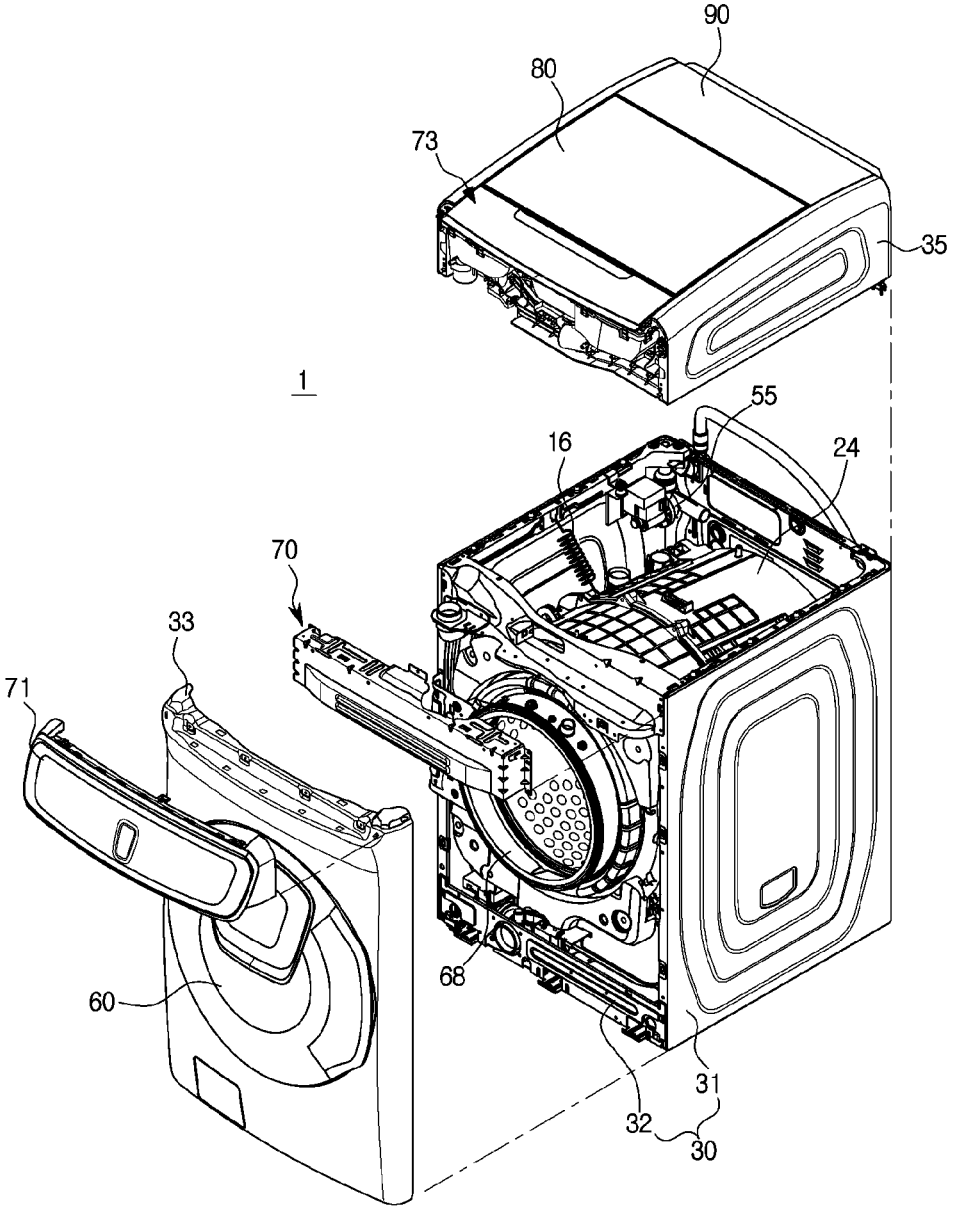
FIG. 2 shows a first washing machine and a second washing machine separated from each other in the washing machine according to an embodiment of the present disclosure.
Figure 3:
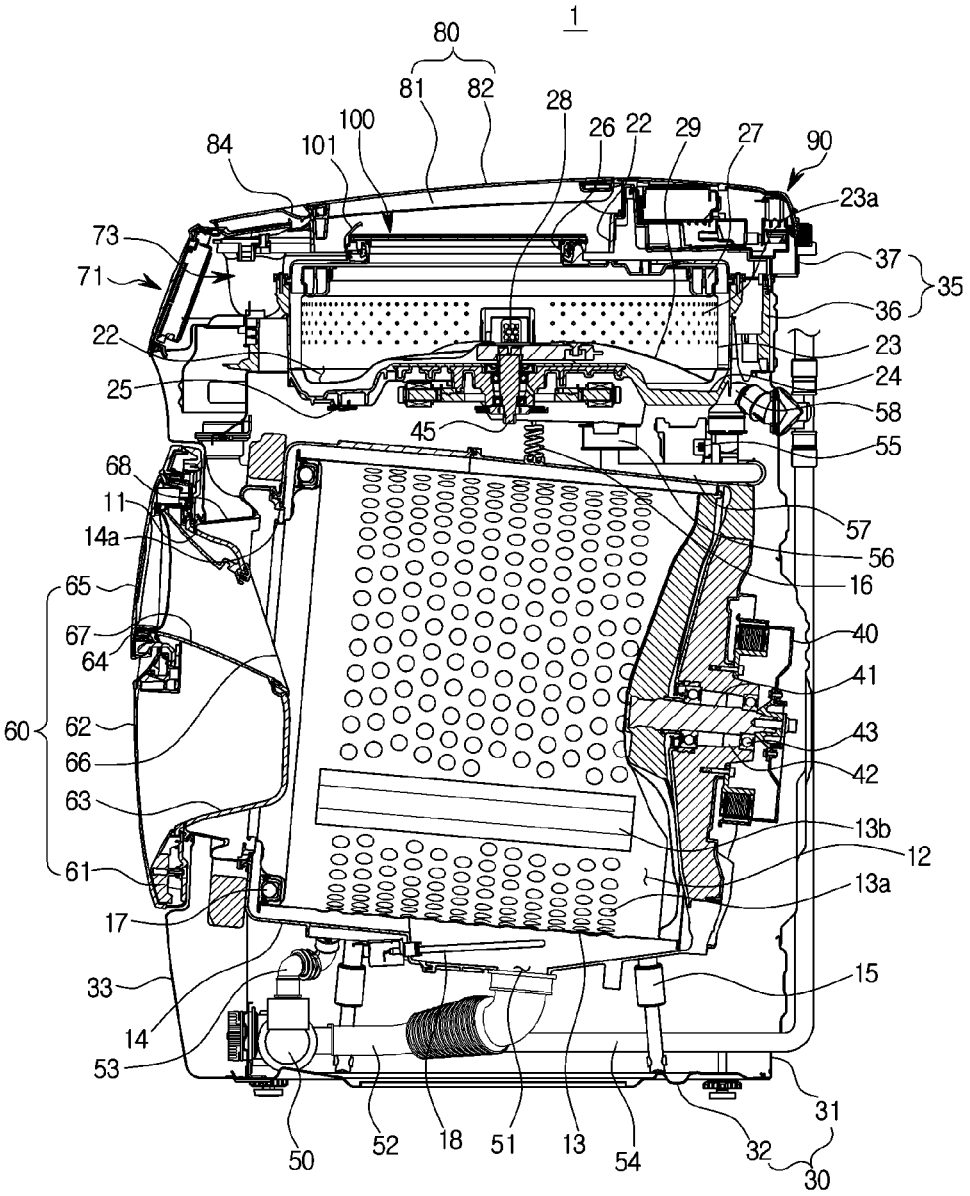
FIG. 3 is a cross-sectional view of the washing machine according to an embodiment of the present disclosure.
Figure 4:
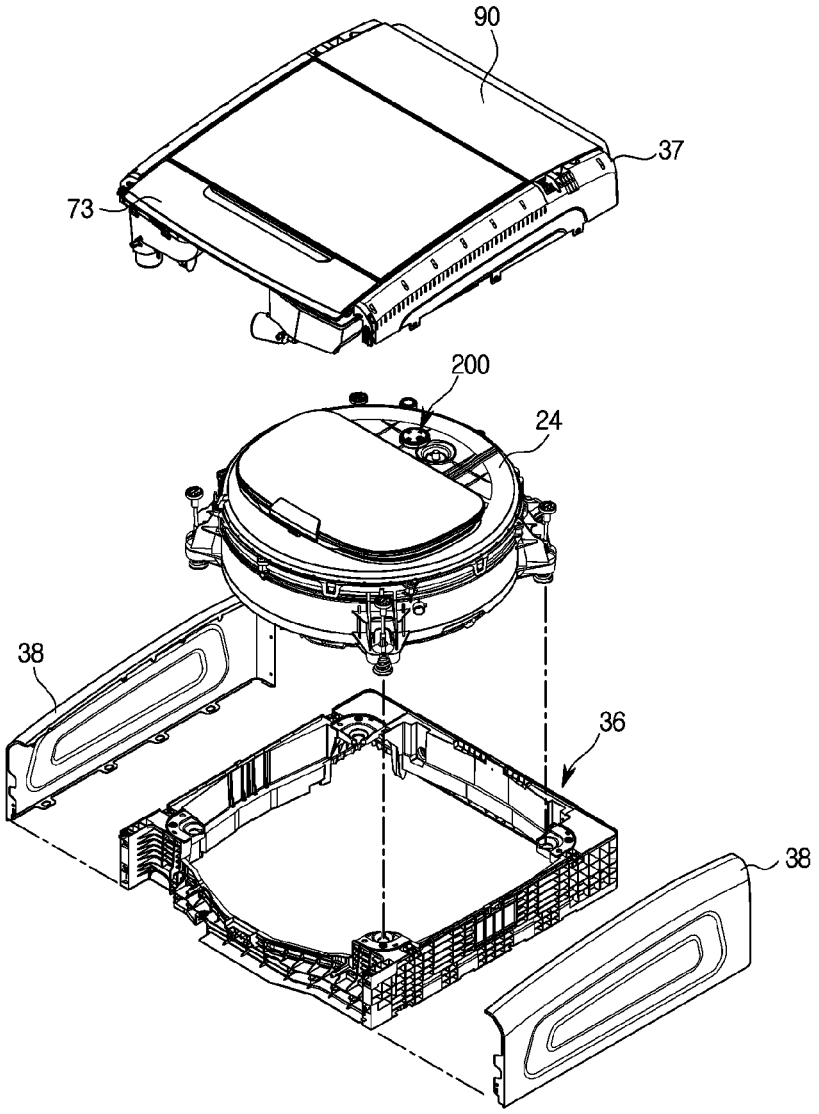
FIG. 4 is an exploded perspective view of a second housing in the washing machine according to an embodiment of the present disclosure.

FIG. 1 is a perspective view of a washing machine according to an embodiment of the present disclosure. FIG. 2 shows a first washing machine and a second washing machine separated from each other in the washing machine according to an embodiment of the present disclosure. FIG. 3 is a cross-sectional view of the washing machine according to an embodiment of the present disclosure. FIG. 4 is an exploded perspective view of a second housing of the washing machine according to an embodiment of the present disclosure, As shown in FIGS. 1, 2, 3 and 4, a washing machine 1 may include a first washing apparatus 10 of a front loading type in which a first laundry inlet 11 is formed at the front portion, and a second washing apparatus 20 of a top loading type in which a second laundry inlet 21 is formed at the top portion.

The second washing apparatus 20 may be mounted on the first washing apparatus 10.

The first washing apparatus 10 may include a first drum 13 forming a first washing space 12 therein, and a first tub 14 accommodating the first drum 13 and storing washing water or rinsing water to be used for a washing course or a rinsing course.

The first drum 13 and the first tub 14 may be in the shape of a cylinder having an opening at one side, wherein the opening may face forward.

The first washing apparatus 10 may include a first housing 30. The first housing 30 may include a side frame 31 forming the side and rear outer appearances of the first washing apparatus 10, and a bottom frame 32 forming a bottom of the first washing apparatus 10.

The first washing apparatus 10 may include a damper 15 and a spring 16 for supporting the first tub 14 on the first housing 30.

The damper 15 may connect an outer surface of the first tub 14 to the bottom frame 32 to support the first tub 14 from below, and the spring 16 may connect the outer surface of the first tub 14 to an upper end of the side frame 31 to support the first tub 14 from above.

The damper 15 and the spring 16 may cushion vibrations, noise, and impacts generated when the first tub 14 moves.

However, the installation positions of the damper 15 and the spring 16 are not limited to the upper portion of the side frame 31 and the bottom frame 32, and the damper 15 and the spring 16 may connect a portion of the first tub 14 to a portion of the first housing 30, as necessary, to support the first tub 14.

The first washing apparatus 10 may include a first driving motor 40 disposed behind the first tub 14 and configured to rotate the first drum 13. A first driving shaft 41 for transferring power of the first driving motor 40 may be connected to a rear surface of the first drum 13.

In a circumferential side of the first drum 13, a plurality of through holes 13*a* may be formed to pass washing water through. On an inner circumferential surface of the first drum 13, a plurality of lifters 13*b* may be installed to raise laundry and drop it when the first drum 13 rotates.

In the front portion of the first drum 13, a first balancer 17 may be installed to help the first drum 13 rotate stably at high speed.

The first driving shaft 41 may be disposed between the first drum 13 and the first driving motor 40. One end of the first driving shaft 41 may be connected to a rear plate of the first drum 13, and the other end of the first driving shaft 41 may extend outward from a rear wall of the first tub 14.

When the first driving motor 40 drives the first driving shaft 41, the first drum 13 connected to the first driving shaft 41 may rotate by the first driving shaft 41.

On the rear wall of the first tub 14, a bearing housing 42 may be installed to rotatably support the first driving shaft 41. The bearing housing 42 may be made of an aluminum alloy, and may be inserted into the rear wall of the first tub 14 when the first tub 14 is injection-molded.

Between the bearing housing 42 and the first driving shaft 41, a plurality of bearings 43 may be installed in order to smoothly rotate the first driving shaft 41.

The first washing apparatus 10 may have a function of washing laundry with high-temperature water. In order to acquire high-temperature water, a heater 18 for heating washing water or rinsing water accommodated in the first tub 14 may be disposed below the first tub 14.

The first washing apparatus 10 may include a first drain pump 50 disposed below the first tub 14 and configured to discharge water in the first tub 14 to the outside of the washing machine 1.

The first washing apparatus 10 may include a first connection hose 52 connecting a first outlet 51 of the first tub 14 to the first drain pump 50 so that water in the first tub 14 can flow to the first drain pump 50.

The first washing apparatus 10 may include a circulation hose 53 connecting the first drain pump 50 to the first tub 14 to circulate water flowed to the first drain pump 50 to the first tub 14, and a first drain hose 54 for guiding water pumped by the first drain pump 50 to the outside of the washing machine 1.

The washing machine 1 may include a front cover 33 having the first inlet 11 to allow a user to put laundry into the first washing space 12 of the first washing apparatus 10. The front cover 33 may be provided to cover at least a portion of the front surface of the first housing 30 and at least a portion of the front surface of the second housing 35.

Although the front cover 33 is shown to cover the entire front surface of the first housing 30 in the drawings, the front cover 33 may cover a portion of the front surface of the first housing 30 and a portion of the front surface of the second housing 35.

A first door 60 for opening or closing the first laundry inlet 11 may be coupled to the front cover 33. The first door 60 may be disposed to correspond to the first laundry inlet 11 and rotate with respect to the front cover 33. The first door 60 may include a first door frame 61, a first door cover 62, and a door glass 63.

In the current embodiment of the present disclosure, the first door frame 61 may be in the shape of a ring, however, the first door frame 61 may be in the shape of a rectangle.

The first door cover 62 and the door glass 63 may be made of a transparent material so that the user can see the inside of the first drum 13 from the outside of the washing machine 1 when the first door 60 closes the first laundry inlet 11.

The door glass 63 may protrude convexly toward the inside of the first drum 13 from the first door frame 61. The door glass 63 may be recessed inward from the first laundry inlet 11, when the first door 60 closes.

The first door 60 may include a first hinge coupling portion (not shown) formed at one side of the first door frame 61 to enable the first door 60 to rotate with respect to the front cover 33. The first hinge coupling portion (not shown) may be coupled with a first hinge (not shown) disposed adjacent to the first laundry inlet 11.

A first hook 69 may be disposed on the other side of the first door frame 61. A first hook accommodating portion 34 may be formed in the front cover 33 in correspondence to the first hook 69 so that the first door 60 can keep the first laundry inlet 11 closed.

In order to enable the user to put laundry into the first washing space 12 when the first door 60 is in a closed state, the first door 60 may include an auxiliary laundry inlet 64 and an auxiliary door 65 for opening or closing the auxiliary laundry inlet 64. The auxiliary door 65 may be rotatably installed on the first door cover 62.

In order for the user to put laundry into the inside of the washing machine 1 through the auxiliary laundry inlet 64 of the first door 60, the laundry may need to pass through the door glass 63. For this, a glass through hole 66 may be formed in the door glass 63.

Alternatively, the upper portion of the door glass 63 may be depressed so that the door glass 63 is not disposed behind the auxiliary laundry inlet 64.

In order to connect the auxiliary laundry inlet 64 of the first door 60 to the glass through hole 66 of the door glass 63, the first door 60 may include a connection guide portion 67. The connection guide portion 67 may be in a shape of a tube that opens at both ends and has a hollow area.

One end of the connection guide portion 67 may be connected to the auxiliary laundry inlet 64, and the other end of the connection guide portion 67 may be connected to the glass through hole 66. In the current embodiment, the connection guide portion 67 may be inclined downward toward the rear direction.

One end of the connection guide portion 67 connected to the auxiliary laundry inlet 64 may be positioned higher than the other end of the connection guide portion 67. Accordingly, the user may easily put laundry into the inside of the first drum 13 through the auxiliary laundry inlet 64.

The first washing apparatus 10 may include a diaphragm 68 disposed between the first laundry inlet 11 of the front cover 33 and a first opening 14*a* of the first tub 14.

The diaphragm 68 may form a passage arriving at the opening 14*a* of the first tub 14 from the first laundry inlet 11, and may reduce vibrations transferred toward the front cover 33 when the first drum 13 rotates.

A portion of the diaphragm 68 may be disposed between the first door 60 and the front cover 33 to prevent washing water in the first tub 14 from leaking to the outside of the washing machine 1.

The washing apparatuses 10 and 20 may include the first washing apparatus 10 and the second washing apparatus 20. The washing spaces 11 and 12 may include a first washing space 11 and a second washing space 12.

The drums 13 and 23 may include a first drum 13 and a second drum 23. The tubs 14 and 24 may include a first tub 14 and a second tub 24.

The second washing apparatus 20 may include the second drum 23 forming a second washing space 22 therein, and the second tub 24 accommodating the second drum 23 and storing washing water or rinsing water to be used for a washing course or a rinsing course.

The second drum 23 and the second tub 24 may be in the shape of a cylinder having an opening at one side, wherein the opening may face upward. The second tub 24 may include a tub body 24*a* and a tub cover 24*b*.

The housings 30 and 35 may include a first housing 30 and a second housing 35. The second washing apparatus 20 may include the second housing 35.

The second housing 35 may include a lower frame 36 on which the second tub 24 is supported, and an upper frame 37 mounted on the lower frame 36 and having the second laundry inlet 21 through which the user can put laundry into the second washing space 22.

The openings 14*a* and 26 may include a first opening 14*a* and a second opening 26. The second laundry inlet 21 may be formed in a direction in which the second opening 26 of the second tub 24 faces.

A side cover 38 may cover the left and right side surfaces of the lower frame 36 and the upper frame 37 with a single member, thereby simplifying the side surface of the second housing 35. Also, when the upper frame 37 is disassembled from the lower frame 36 due to vibrations or the like, the side cover 38 may prevent the upper frame 37 from being separated from the lower frame 36, thereby preventing the user's injury.

The side cover 38 may make the first housing 30 of the first washing apparatus 10 and the second housing 35 of the second washing apparatus 20 have a unified esthetic sense when the second washing apparatus 20 is coupled with the first washing apparatus 10.

The second washing apparatus 20 may include a lid 80 configured to open or close the second laundry inlet 21. The lid 80 may be disposed to correspond to the second laundry inlet 21, and configured to rotate with respect to the upper frame 37.

The lid 80 may include a lid handle 84 for allowing the user to grasp the lid 80 and rotate it. The lid handle 84 may be disposed at one end of the lid 80 that is opposite to a pivot axis of the lid 80.

The lid 80 may include a lid frame 81 and a lid cover 82. The lid cover 82 may be made of a transparent material so that the user can see the second tub 24 and the second drum 23 from the outside of the washing machine 1 when the lid 80 closes the second laundry inlet 21.

A second hinge (not shown) may be disposed at left and right edges of the lid frame 81 so that the lid 80 can rotate with respect to the upper frame 37. The second hinge may be coupled with a second hinge coupling portion (not shown) formed around the second laundry inlet 21.

In a front edge of the lid frame 81, a latch accommodating portion 83 may be disposed, and a latch member (not shown) may be disposed in the upper frame 37 to correspond to the latch accommodating portion 83 of the lid frame 81.

The lid 80 may keep the second laundry inlet 21 closed when the second washing apparatus 20 operates. The second drum 23 may be in the shape of a cylinder whose upper portion opens. The second drum 23 may be rotatable in the inside of the second tub 24.

The plurality of through holes 13*a* and 23*a* may include a plurality of first through holes 13*a* and a plurality of second through holes 23*a*. The plurality of second through holes 23*a* for a flow of washing water may be formed in the side and bottom surfaces of the second drum 23.

Balancers 17 and 27 including a first balancer 17 and a second balancer 27 may be provided. The second balancer 27 may be mounted on the upper portion of the second drum 23 to help the second drum 23 rotate stably at high speed.

A filter 28 may be attached on an inner side surface of the second drum 23 to filter out foreign materials generated during washing.

On the bottom of the second drum 23, a curved portion 29 may be formed to generate water current. The second washing apparatus 20 may include a pulsator (not shown) disposed in the inside of the second drum 23 and configured to generate water current.

The second tub 24 may be in the shape of a cylinder and supported on the lower frame 36 by a suspension member 25. The second tub 24 may be supported in such a way to hang from the lower frame 36 by four suspension members 25.

Doors 60 and 100 including the first door 60 and a second door 100 may be provided. The second opening 26 may be formed in the upper surface of the second tub 24 to correspond to the second laundry inlet 21, and the second door 100 may be coupled to the upper surface of the second tub 24 to open or close the second opening 26.

The second door 100 may seal the second washing space 22 so as to prevent leakage of wet steam during high-temperature washing. The second door 100 may include a second door frame 110 and a second door cover 120. The second door 100 may open or close the second opening 26 of the second tub 24.

The second door frame 110 may include a door handle 101 for allowing the user to open the second door 100. A second hook 102 may be disposed on the door handle 101.

The drive motors 40 and 44 may include a first drive motor 40 and a second drive motor 44. The second washing apparatus 20 may include the second driving motor 44 disposed on a lower outer portion of the second tub 24 and configured to rotate the second drum 23.

The driving shafts 41 and 45 may include a first driving shaft 41 and a second driving shaft 45. The second driving shaft 45 for transmitting power of the second driving motor 44 may be connected to the bottom surface of the second drum 23.

One end of the second driving shaft 45 may be connected to a bottom plate of the second drum 23 and the other end of the second driving shaft 45 may extend outward from a bottom wall of the second tub 24. When the second driving motor 44 drives the second driving shaft 45, the second drum 23 connected to the second driving shaft 45 can rotate on the second driving shaft 45.

When a pulsator (not shown) is disposed on the bottom of the second drum 23, the second washing apparatus 20 may further include a power switch apparatus (not shown) for transferring a driving force generated by the second driving motor 44 simultaneously or selectively to the second drum 23 and the pulsator (not shown).

Drain pumps 50 and 55 including the first drain pump 50 and a second drain pump 55 may be provided. The second drain pump 55 for discharging water in the second tub 24 to the outside of the washing machine 1 may be disposed in the first washing apparatus 10.

Drain hoses 54 and 58 including the first drain hose 54 and a second drain hose 58 may be provided. The first washing apparatus 10 may include the second drain pump 55 disposed at the upper portion of the first housing 30, and the second drain hose 58 for guiding water pumped by the second drain pump 55 to the outside of the washing machine 1.

Drain ports 51 and 56 including the first drain port 51 and a second drain port 56 may be provided. The second drain part 56 for draining water stored in the second tub 24 may be formed in the bottom of the second tub 24.

Connection hoses 52 and 57 including the first connection hose 52 and a second connection hose 57 may be provided. The second drain port 56 and the second drain pump 55 may be connected by the second connection hose 57 so that water stored in the second tub 24 is introduced into the second drain pump 55.

The second washing apparatus 20 may include a water supply apparatus 90 for supplying washing water to the second tub 24 and the first tub 14 of the first washing apparatus 10. The water supply apparatus 90 may be installed in the second housing 35.

The water supply apparatus 90 may be disposed on the upper frame 37, and preferably, the water supply apparatus 90 may be disposed behind the second laundry inlet 21.

The second washing apparatus 20 may include a first detergent supply apparatus 72 for storing a fabric softener and/or a bleaching agent to be supplied to the second laundry space 22. The first detergent supply apparatus 72 may be disposed on the upper frame 37, and may include a detergent case 72*a*. The detergent case 72*a* may have an opening that opens substantially upward.

A plurality of first detergent supply apparatuses 72 may be respectively disposed at left and right sides of a front portion of the second opening 26. The user may open the lid 80 to access the first detergent supply apparatuses 72.

The detergent supply apparatuses 72 and 73 may include a first detergent supply apparatus 72 and a second detergent supply apparatus 73. The second washing apparatus 20 may include the second detergent supply apparatus 73 for supplying detergent to the first washing apparatus 10. The second detergent supply apparatus 73 may be disposed in the second housing 35.

The second detergent supply apparatus 73 may be disposed in the upper frame 37, and preferably, disposed in front of the second laundry inlet 21.

The washing machine 1 may include a fixing bracket 70 for coupling the second washing apparatus 20 with the first washing apparatus 10 such that the second washing apparatus 20 is not separated from the first washing apparatus 10. The fixing bracket 70 may fix the first washing apparatus 10 and the second washing apparatus 20 on the front surfaces of the first washing apparatus 10 and the second washing apparatus 20.

The fixing bracket 70 may be disposed inside the front cover 33 to fix the front portion of the first housing 30 and the front portion of the second housing 35.

The fixing bracket 70 may be in the shape of a rectangular parallelepiped having a length corresponding to a width in left-right direction of the first housing 30 and the second housing 35, and having a thickness corresponding to the thickness of the front cover 33.

The first tub 14 may be supported on the first housing 30 by a spring 16. The spring 16 may reduce vibrations and noise generated by the first tub 14. However, vibrations generated by the first tub 14 may be transferred to the first housing 30 by the spring 16.

Since a height A of the front cover 33 is higher than a height B of the first housing 30 with which the spring 16 is coupled, it may be possible to secure stiffness for supporting the front portion of the washing machine 1, while efficiently preventing vibrations of the first housing 30 and the second housing 35 from being transferred in the front direction.

Also, since the front portion of the washing machine 1 is configured with the front cover 33 and the control panel 71 disposed on the upper portion of the front cover 33, an esthetic effect may be provided.

A height of the fixing bracket 70 may be higher than or equal to a height of the second driving motor 44 disposed outside the bottom of the second tub 24.

The fixing bracket 70 may include a fire-resistant material such as a metal, and may be higher than the second driving motor 44. Therefore, when a fire breaks out due to overheating of the second driving motor 44, the fixing bracket 70 may prevent the fire from spreading toward the control panel 71.

The washing machine 1 may include the control panel 71 disposed on the front cover 33 to enable the user to control the first washing apparatus 10 and the second washing apparatus 20.

The control panel 71 may include an input device (not shown) for receiving operation commands for the washing machine 1 from the user, and a display (not shown) for displaying operation information of the washing machine 1.

The side covers 38 may be coupled with the upper frame 37 and the lower frame 36 to cover side surfaces of the upper frame 37 and side surfaces of the lower frame 36.

In the lower frame 36, vibrations may be generated by the second tub 24 supported on the lower frame 36. Also, by coupling of the lower frame 36 and the upper frame 37, vibrations of the lower frame 36 may be transferred to the upper frame 37.

When the lower frame 361 and the upper frame 37 are disassembled by vibrations, etc., the side covers 38 may prevent the lower frame 36 and the upper frame 37 from being separated, thereby preventing the user's injury.

Also, the side covers 38 may cover the left and right side surfaces of the lower frame 36 and the upper frame 37 with a single member, thereby simplifying the side surfaces of the second housing 35. Also, the side covers 38 may make the first housing 30 and the second housing 35 have a unified esthetic sense after the second housing 35 is coupled with the first housing 30.

The second tub 24 may include a discharge apparatus 200.

Figure 5:
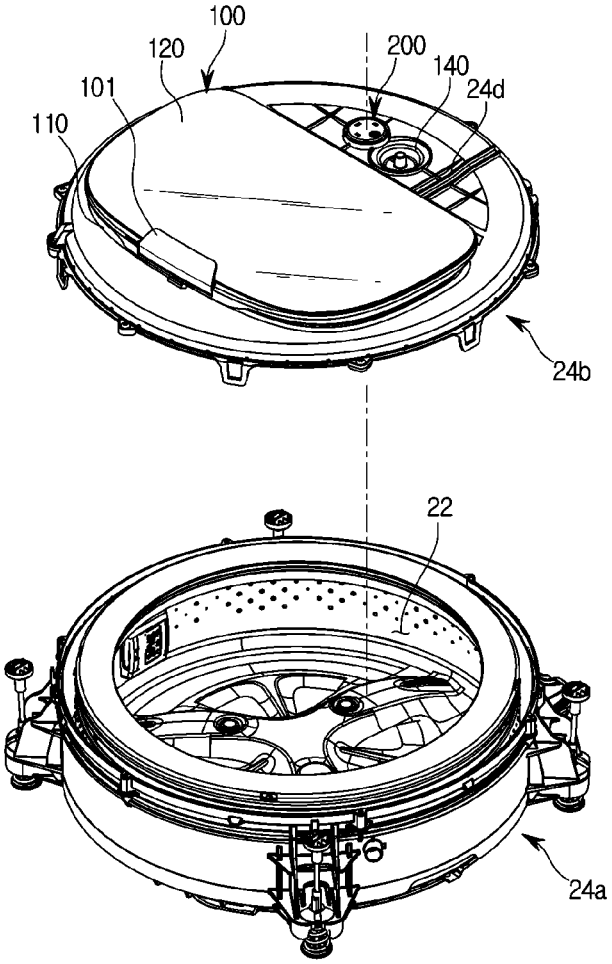
FIG. 5 shows a second tub and a second door in the washing machine according to an embodiment of the present disclosure.
Figure 6:
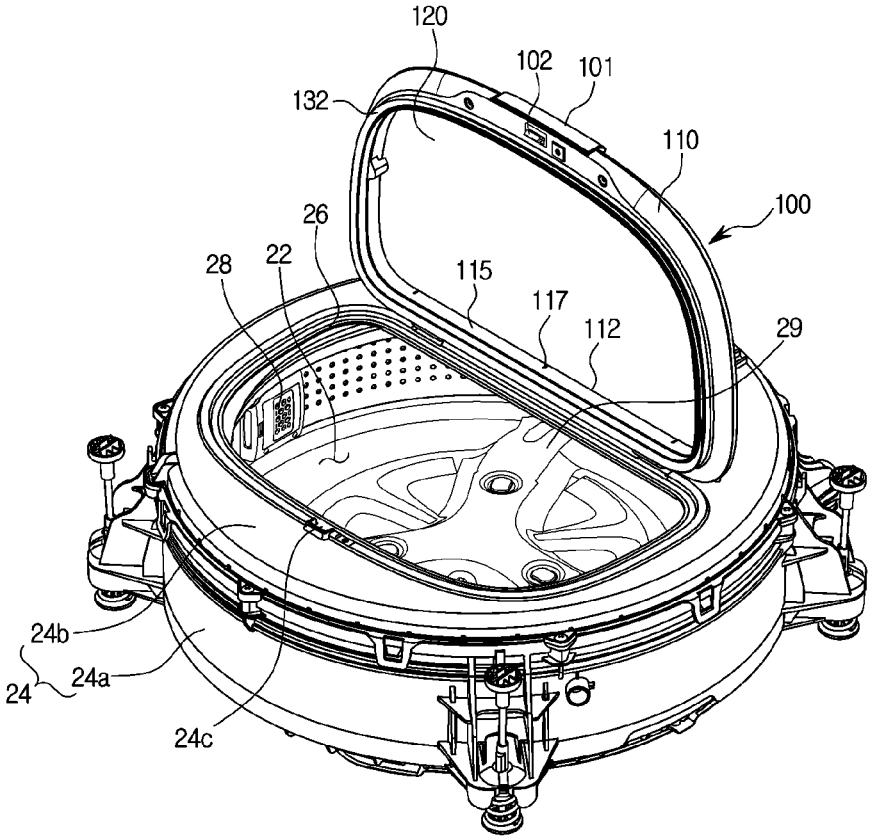
FIG. 6 shows a state in which the second door is opened in the washing machine according to an embodiment of the present disclosure.
Figure 7:
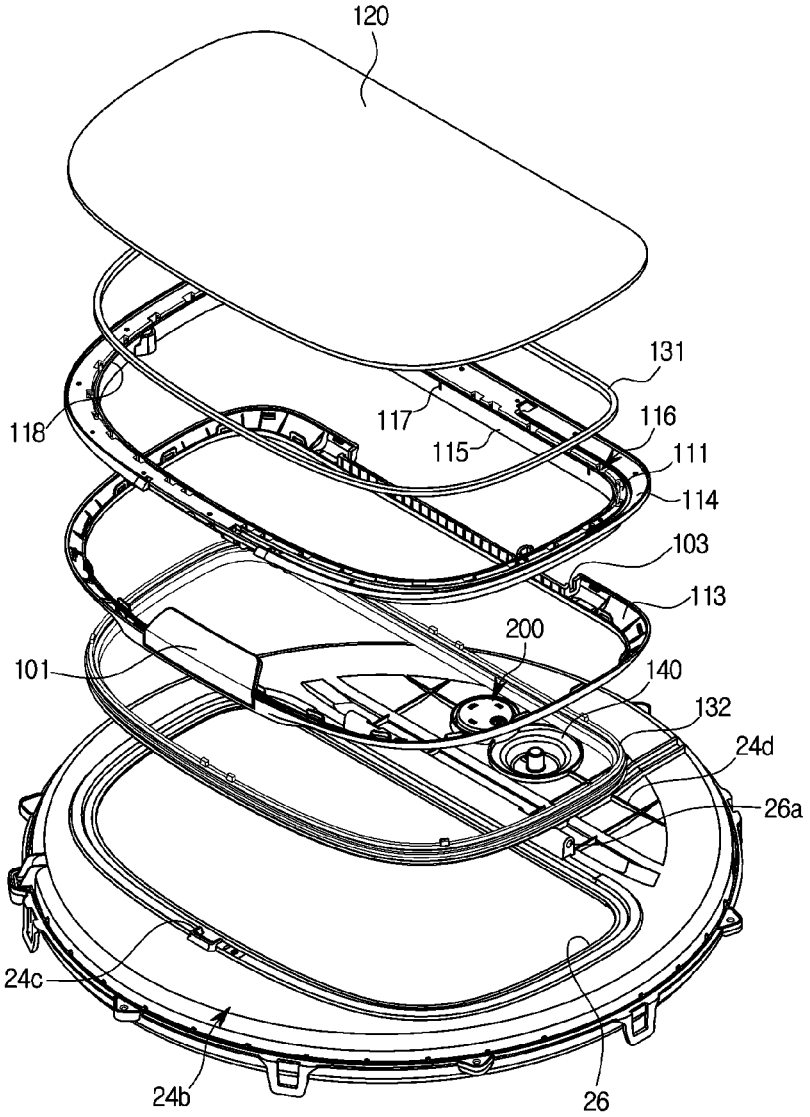
FIG. 7 is an exploded perspective view of a tub cover and the second door in the washing machine according to an embodiment of the present disclosure.

FIG. 5 shows a second tub and a second door in the washing machine according to an embodiment of the present disclosure. FIG. 6 shows a state in which the second door is opened in the washing machine according to an embodiment of the present disclosure. FIG. 7 is an exploded perspective view of a tub cover and the second door in the washing machine according to an embodiment of the present disclosure.

As shown in FIGS. 5 to 7, the second tub 24 may include a tub body 24*a* and a tub cover 24*b*. The tub body 24*a* may be in the shape of a cylinder whose upper portion opens.

The tub cover 24*b* may cover the open upper portion of the tub body 24*a*. A second opening 26 may be formed in the tub cover 24*b*. The tub cover 24*b* may be coupled and/or fixed to the tub body 24*a*.

However, the present disclosure is not limited thereto, and the tub body 24*a* and the tub cover 24*b* may be integrated into one body.

The second door 100 may include the second door frame 110 and the second door cover 120. The second door frame 110 may include a first frame 113 and a second frame 114. The first frame 113 may cover a portion of a lower end of the second frame 114.

However, the present disclosure is not limited thereto, and the second door frame 110 may be formed as one body.

The second door frame 110 may be rotatably mounted on the tub cover 24*b*. A third hinge 26*a* may be disposed around the second opening 26 so that the second door 100 can rotate with respect to the second tub 24.

The third hinge 26*a* may be coupled to a third hinge coupling portion 103 formed on one side of the second door frame 110.

The door handle 101 may be provided at the other side of the second door frame 110, which is opposite to the side at which the third hinge coupling portion 103 is disposed, to allow the user to open the second door 100. A second hook 102 may be provided at the door handle 101.

The second tub 24 may include a second hook receiving portion 24*c* corresponding to the second hook 102. The second door 100 may close the second opening 26. When the user pulls the door handle 101, the second hook 102 may escape from the second hook receiving portion 24*c*. The second door 100 may fully open the second washing space 22.

The second door frame 110 may include a door hole 118 for allowing the user to see the inside of the second tub 24 even when the second door 100 closes the second opening 26. The door hole 118 may penetrate the second tub 24.

The second door 100 may include sealing members 131 and 132, and the sealing members 131 and 132 may include a first sealing member 131 and a second sealing member 132.

The second door frame 110 may include an insertion portion 116 into which at least a portion of the first sealing member 131 is inserted. The insertion portion 116 may be formed along a circumference of the door hole 118. The first sealing member 131 may be fixed to the second door frame 110.

The second door frame 110 may include a water collecting space 111 for collecting water flowing along one side of the second door 100 when the second door 100 opens the second opening 26, and a water collecting cover 115 for covering at least a portion of the water collecting space 111.

The second door frame 110 may include the water collecting space 111 so as to prevent washing water flowing in the direction of gravity from falling into washed laundry in the second washing space 22 and rewetting the laundry.

The water collecting space 111 may communicate with the outside through an inflow gap 112. Water existing on the inner surface of the second door cover 120 may move downward by gravity when the second door 100 opens, and then flow into the water collecting space 111 through the inflow gap 112.

The inflow gap 112 may be formed between the second door cover 120 and the water collecting cover 115. The inflow gap 112 may be formed when the water collecting cover 115 is spaced apart from one side of the second door cover 120.

The water collecting cover 115 may be disposed in at least one portion of the door hole 118 along the circumference of the door hole 118. The water collecting cover 115 may be spaced a predetermined distance from a portion of the second door cover 120 to form the inflow gap 112 between the water collecting cover 115 and the second door cover 120.

The water collecting cover 115 may include a third drain portion 117. The third drain portion 117 may discharge water collected in the water collecting space 111 from the water collecting space 111 when the second door 100 closes the second opening 26.

The third drain portion 117 may guide the water collected in the water collecting space 111 to the inside of the second tub 24. The water collecting space 111 may communicate with the outside through the third drain portion 117.

The second door cover 120 may be mounted on the second door frame 110. The second door cover 120 may include a transparent material so that the user can see the inside of the second drum 23 from the outside of the second tub 24 through the door hole 118 even when the second door 100 closes the second opening 26.

The second door cover 120 may be fixed to the second door frame 110 by an adhesive. The adhesive may seal up a gap between the second door cover 120 and the second door frame 110.

However, the present disclosure is not limited thereto, and the second door 100 of the washing machine 1 may include the first sealing member 131 to seal up the gap between the second door cover 120 and the second door frame 110.

The first sealing member 131 may be disposed along the outer circumference of the door hole 118. The first sealing member 131 may prevent washing water stored in the second tub 24 from being discharged to the outside during a washing process.

The first sealing member 131 may prevent wet steam from leaking out when the second washing machine 20 performs a washing process with high-temperature washing water.

A portion of the first sealing member 131 may be disposed in the water collecting space 111. One side of the first sealing member 131 may be fixed to the second door cover 120. The one side of the first sealing member 131 may be fixed to the second door cover 120 by an adhesive.

The upper surface of the first sealing member 131 may be in surface contact with the lower surface of the second door cover 120. The first sealing member 131 may seal up a gap between the second door frame 110 and the second door cover 120.

Since the first sealing member 131 is inserted into the insertion portion 116 of the second door frame 110, the first sealing member 131 may be not exposed to the user when the second door 100 opens.

The second door 100 may include a second sealing member 132 for sealing up a gap formed between the second door 100 and the second tub 24. The second sealing member 132 may seal up the gap between the second tub cover 24*b* and the second door 100.

The second sealing member 132 may be disposed at a lower end of the second door frame 110. The second sealing member 132 may prevent washing water stored in the second tub 24 from leaking to the outside during a washing process.

The second sealing member 132 may prevent wet steam from leaking out when the second washing apparatus 20 performs a washing process with high-temperature washing water. The second tub 24 may include a filter 28 and a curved portion 29.

The second tub 24 may include a discharge apparatus 200 and a connection member 140 to which a water supply apparatus 90 for supplying water to the second tub 24 is connected. The second tub cover 24*b* may include the discharge apparatus 200 and the connection member 140.

The second tub cover 24*b* may include a water supply unit 24*d* disposed behind the second door 100 and covered by the second housing 35 covering the water supply apparatus 90.

The connection member 140 and the discharge apparatus 200 may be disposed in the water supply unit 24*d*. Hereinafter, the discharging apparatus 200 will be described in detail.

Figure 8:
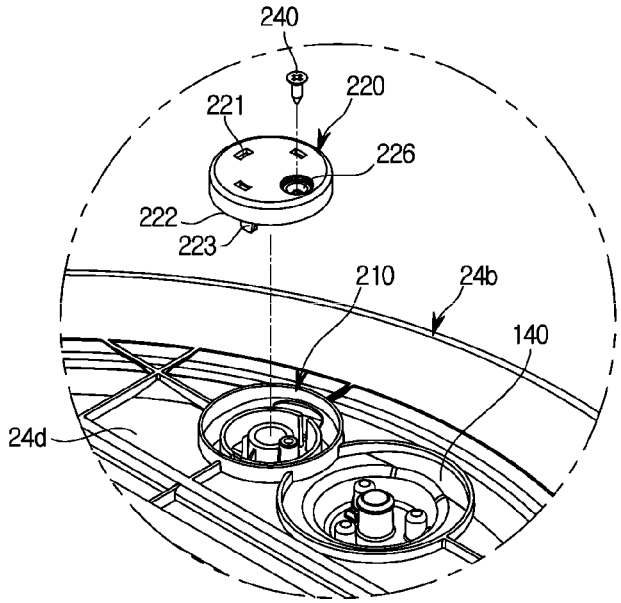
FIG. 8 is an exploded perspective view of a discharge member in the washing machine according to an embodiment of the present disclosure.

FIG. 8 is an exploded perspective view of a discharge member in the washing machine according to an embodiment of the present disclosure. As shown in FIG. 8, the discharge apparatus 200 may include a discharge member 210 provided in the tubs 14 and 24 so that air in the drums 13 and 23 is discharged to the outside of the tubs 14 and 24.

The discharge apparatus 200 may include the discharge member 210 provided in the second tub 24 so that air in the second drum 23 is discharged to the outside of the second tub 24.

The discharge apparatus 200 may include a cap 220 coupled to the discharge member 210 to prevent water in the drums 13 and 23 from being discharged to the outside of the tubs 14 and 24 through the discharge member 210.

The discharge apparatus 200 may include the cap 220 coupled to the discharge member 210 to prevent water in the second drum 23 from being discharged to the outside of the second tub 24 through the discharge member 210.

In the washing machine 1 according to the present disclosure, the second washing apparatus 20 may be mounted on the first washing apparatus 10, and the internal space of the second washing apparatus 20 may have a relatively lower height than that of the first washing apparatus 10.

Since the height of the internal space of the second washing apparatus 20 is relatively lower than that of the first washing apparatus 10, water in the second tub 23 may be discharged to the outside of the second tub 24 through the second laundry inlet 21 when the second washing apparatus 20 is driven.

Therefore, the washing machine 1 according to the present disclosure may include the sealing members 131 and 132 for sealing up the gap between the second laundry inlet 21 and the second door 100, in order to prevent washing water in the second drum 23 from being discharged to the outside of the second tub 24 through the second laundry inlet 21.

However, when the second drum 23 is driven, inside pressure of the second tub 24 may increase relative to inside pressure of the first tub 14 by the sealing members 131 and 132.

In this case, a sensor (not shown) for checking the inside pressure of the second tub 24 may fail to accurately measure the inside pressure of the second tub 24.

The washing machine 1 according to the present disclosure may include the discharge member 210 for discharging inside air of the second drum 23 to the outside of the second tub 24 in order to prevent the inside pressure of the second drum 23 from rising by the sealing members 131 and 132.

The second tub 24 may include a tub body 24*a* whose upper portion opens and a tub cover 24*b* for covering the open upper portion of the tub body 24*b*. The discharge member 210 may be disposed in the tub cover 24*b*.

The tub cover 24*b* may include a second door 100 for opening or closing the second laundry inlet 21, and the discharge member 210 may be disposed behind the second door 100 in such a way to be adjacent to the center of the second drum 23.

The discharge member 210 may be positioned adjacent to the center of the second drum 23 so as to prevent water stored in the second drum 23 from being discharged to the outside of the second tub 24 through the discharge member 210, when the second drum 23 is driven.

That is, when the second drum 23 is driven, water stored in the second drum 23 may be directed toward the edge of the second drum 23 by a rotational force of the second drum 23, and accordingly, an amount of water remaining in the center of the second drum 23 may be smaller than an amount of water remaining in the edge of the second drum 23.

Since the second door 100 is located on the upper center of the second drum 23, it may be preferable that the discharge member 210 is provided behind the second door 100 so long as the discharge member 210 is directed toward the center of the second drum 23 and does not damage the esthetic sense of the washing machine 1.

The second tub cover 24*b* may include the water supply unit 24*d* disposed behind the second door 100 so as to be covered by the second housing 35 covering the water supply apparatus 90.

The connection member 140 and the discharge apparatus 200 may be disposed in the water supply unit 24*d*. The discharge member 210 may be disposed on the tub cover 24*b* in such a way to be adjacent to the connection member 140.

The discharge member 210 and the cap 220 may be fixed and coupled by a fastening member 240 such as a screw. The cap 220 may include a second fastening portion 226 through which the fastening member 240 passes.

The cap 220 may be coupled to a upper portion of the discharge member 210 so as to prevent water stored in the second drum 23 from being discharged to the outside of the second tub 24 through the discharge member 210.

The cap 220 may include an air hole 221 to discharge inside air of the second drum 23 to the outside of the second tub 24 when the cap 220 is coupled to the discharge member 210. A plurality of air holes 221 may be provided.

The cap 220 may include partition walls 222 and 223 protruding downward from an upper surface of the cap 220. The partition walls 222 and 223 may include an outer partition wall 222 and an inner partition wall 223 configured to be coupled to the discharge member 210.

Figure 9:
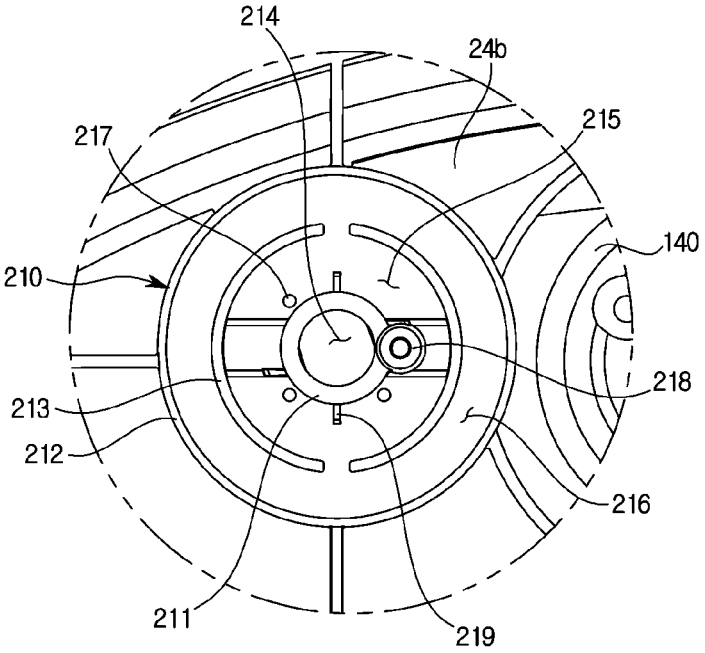
FIG. 9 is a cross-sectional view of the discharge member in the washing machine according to an embodiment of the present disclosure.

FIG. 9 is a cross-sectional view of the discharge member in the washing machine according to an embodiment of the present disclosure. As shown in FIG. 9, the discharge member 210 may include a plurality of ribs 211, 212 and 213 protruding upward from a bottom surface of the discharge member 210.

The ribs 211, 212 and 213 may have a substantially circular shape although not limited thereto. The discharge member 210 may be connected to the connection member 140. The discharge member 210 and the connection member 140 may be disposed on the tub cover 24*b*.

The ribs 211, 212 and 213 may have an outer rib 212 forming an outer appearance of the discharge member 210 and an inner rib 211 disposed inside the outer rib 212 to form a discharge hole 214 communicating with the second drum 23.

The ribs 211, 212 and 213 may include a middle rib 213 disposed between the outer rib 212 and the inner rib 211.

The discharge member 210 may have a first space 215 formed between the inner rib 211 and the middle rib 213 and a second space 216 formed between the middle rib 213 and the outer rib 212.

A cross-section area of the discharge hole 214 may be smaller than a cross-section area of the first space 215 formed between the inner rib 211 and the middle rib 213.

Accordingly, the inside air of the second drum 23 may be easily discharged to the outside of the second tub 24 through the discharge member 210.

The discharge member 210 may include a drain hole 217 formed at the bottom of the discharge member 210 so that water introduced into the discharge member 210 is discharged again to the second drum 23.

The cap 220 may be coupled with the discharge member 210 to prevent water from being discharged from the inside of the second tub 24 through the discharge member 210 for discharging the inside air of the second tub 24.

When water discharged from the second drum 23 through the discharge hole 214 is blocked by the cap 220 and received in the discharge member 210, the water may be introduced again into the second drum 23 through the drain hole 217.

The drain hole 217 may be located between the inner rib 211 and the middle rib 213. The drain hole 217 may be disposed adjacent to the inner rib 211 rather than the middle rib 213, although not limited thereto.

Since the drain hole 217 is disposed not between the middle rib 213 and the outer rib 212 but between the inner rib 211 and the middle rib 213, water in the second drum 23 may be prevented from being discharged to the outside of the second tub 24 through the drain hole 217.

The middle rib 213 may form a slot through which water introduced into the second space 216 is discharged to the drain hole 217. At least a portion of the middle rib 21 may be cut off.

Since the second space 216 has no drain hole, the middle rib 213 may communicate with the first space 215 and the second space 216 so that water contained in the second space 216 is drained through the drain hole 217 of the first space 215.

A plurality of middle ribs 213 may be provided in such a way to be spaced apart from each other.

The discharge member 210 may include a first fastening portion 218 that is coupled with the cap 220 by the fastening member 240. When the fastening member 240 is fastened to the first fastening portion 218 of the discharge member 210 and the second fastening portion 226 of the cap 220, the discharge member 210 may be fastened and coupled to the cap 220.

The discharge member 210 may include a coupling protrusion 219 that is assembled with the cap 220. A plurality of coupling protrusions 219 may be provided. The coupling protrusion 219 may extend from the inner rib 211 although not limited thereto.

Figure 10:
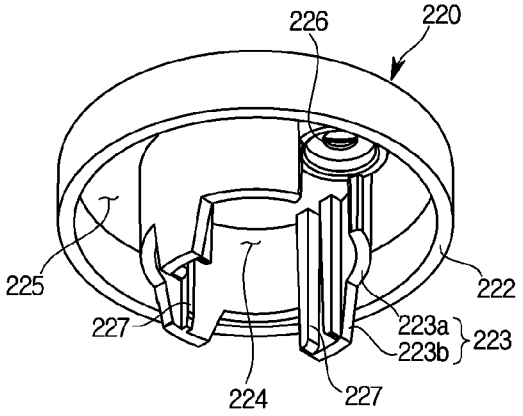
FIG. 10 is a perspective view of a cap in the washing machine according to an embodiment of the present disclosure.

FIG. 10 is a perspective view of a cap in the washing machine according to an embodiment of the present disclosure. As shown in FIG. 10, the cap 220 may include the partition walls 222 and 223 protruding downward from an upper surface of the cap 220.

The partition walls 222 and 223 may include the outer partition wall 222 forming an outer appearance of the cap 220 and the inner partition wall 223 disposed inside the outer partition wall 222. The partition walls 222 and 223 may have a substantially circular shape although not limited thereto.

A plurality of inner partition walls 223 may be provided.

A length of the inner partition wall 223 protruding downward from the upper surface of the cap 220 may be longer than that of the outer partition wall 222 protruding downward from the upper surface of the cap 220.

Therefore, inside air of the second drum 23 may be easily discharged to the outside of the second tub 24 through the discharge member 210 and the cap 220.

The inner partition wall 223 may include a first inner partition wall 223*a* protruding downward from the upper surface of the cap 220, and a second inner partition wall 223*b* extending downward from the first inner partition wall 223*a* to be in contact with the bottom surface of the discharge member 210.

The first inner partition wall 223*a* may have a length that is shorter than that of the second inner partition wall 223*b* to form a flow path A for discharging the inside air of the second drum 23 to the outside of the second tub 24 through the discharge member 210 when the cap 220 is engaged with the discharge member 210.

The second inner partition wall 223*b* may have a length to enable the cap 220 to contact the bottom surface of the discharge member 210 in order to increase a coupling force when the cap 220 is engaged with the discharge member 210. A plurality of second inner partition walls 223*b* may be provided.

The cap 220 may include an inner rib accommodating portion 224 in which the inner rib 211 is accommodated and an middle rib accommodating portion 225 in which the middle rib 213 is accommodated when the cap 220 is engaged with the discharge member 210.

The cap 220 may include the second fastening portion 226 through which the fastening member 240 passes. The cap 220 may include a coupling portion 227 for increasing a coupling force with the discharge member 210. The coupling portion 227 may be formed on the inner side of the inner partition wall 223 although not limited thereto.

A plurality of coupling portions 227 may be provided.

Figure 11:
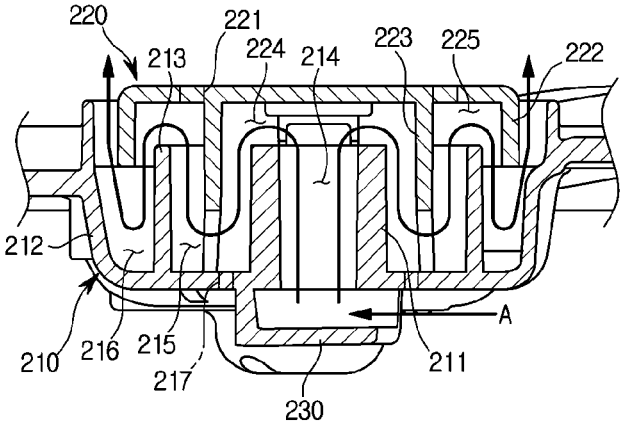
FIG. 11 shows a flow of air through the discharge member in the washing machine according to an embodiment of the present disclosure.

FIG. 11 shows a flow of air through the discharge member in the washing machine according to an embodiment of the present disclosure. As shown in FIG. 11, the discharge member 210 may be coupled to the cap 220 to form a flow path A through the ribs 211, 212 and 213 and the partitions 222 and 223 that are arranged alternately.

Water and air in the second drum 23 may be discharged to the outside of the second tub 24 through the flow path A.

The discharge apparatus 200 may include a cover member 230 disposed on the bottom of the discharge member 210 to prevent water in the second drum 23 from being discharged directly from the second drum 23 through the discharge hole 214.

When the discharge member 210 is coupled to the cap 220, the inner rib 211 may be accommodated in the inner rib accommodating portion 224, and the inner partition wall 223 may be accommodated in the first space 215.

The middle rib 213 may be accommodated in the middle rib accommodating portion 225, and the outer partition wall 222 may be accommodated in the second space 216.

The ribs 211, 212 and 213 and the partition walls 222 and 223 may be arranged alternately, as described above. Accordingly, when water in the second drum 23 is guided to the outside of the second tub 24 together with air, the air may be easily discharged to the outside, whereas the water may be prevented from being discharged.

The water and air guided and discharged through the cover member 230 from the second drum 23 may be discharged through the discharge hole 214 to the inner rib accommodating portion 224, the first space 215, the middle rib accommodating portion 225, and the second space 216, sequentially, and then discharged to a space between the outer partition wall 222 and the outer rib 212.

When water in the second drum 23 is discharged together with air, the water may collide with the ribs 211, 212 and 213 and the partition walls 222 and 223 to be accommodated in the first space 215 and the second space 216.

The water accommodated in the second space 216 may be discharged to the first space 215 through the slot of the middle rib 213, and the water accommodated in the first space 215 may be drained again to the inside of the second drum 23 through the drain hole 217.

The cap 220 may include the air hole 221 to easily discharge the inside air of the second drum 23 to the outside of the second tub 24. The air hole 221 may be disposed between the outer partition wall 222 and the inner partition wall 223.

The air hole 221 may be disposed adjacent to the inner partition wall 223 than the outer partition wall 222, although not limited thereto. A plurality of air holes 221 may be provided.

Figure 12:
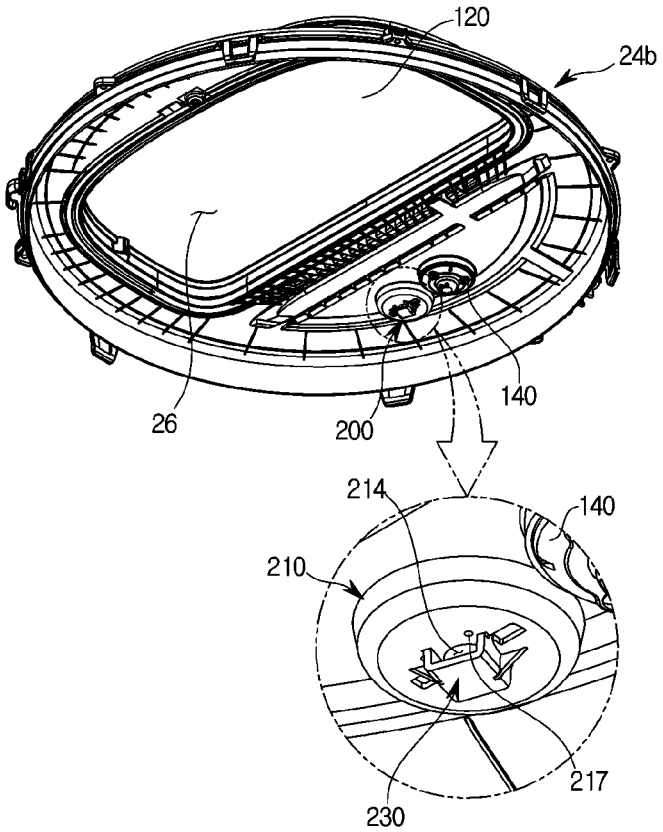
FIG. 12 shows a cover member in the washing machine according to an embodiment of the present disclosure.

FIG. 12 shows a cover member in the washing machine according to an embodiment of the present disclosure. As shown in FIG. 12, a discharge apparatus 200 may be disposed on the tub cover 24*b* including the second door 100 to cover the second opening 26.

The discharge member 210 included in the discharge apparatus 200 may protrude downward from the bottom of the tub cover 24*b*, and the discharge member 210 may be disposed adjacent to the connection member 140.

The discharge hole 214 and the drain hole 217 may be formed in the bottom of the discharge member 210 to communicate with the second drum 23. A cross-section area of the discharge hole 214 may be larger than a cross-section area of the drain hole 217. A plurality of drain holes 217 may be provided.

The discharge apparatus 200 may include the cover member 230 disposed on the bottom of the discharge member 210 to prevent water in the second drum 23 from being discharged directly from the second drum 23 to the discharge hole 214.

The cover member 230 may have a substantially '□'-shaped cross section. The cover member 230 may be connected to the bottom of the discharge member 210 so as to cover the discharge hole 214 without covering the drain hole 217.

By the cover member 230, water in the second drum 23 may be guided to the discharge member 210 through the flow path A without being directly discharged to the discharge hole 214.

Although a few embodiments of the present disclosure have been shown and described, the scope of the present invention is not limited to the embodiments.

It would be appreciated by those skilled in the art that various modifications, equivalents, and other embodiments are possible without departing from the scope and sprit of the present invention.

The invention claimed is:

1. A washing machine comprising:

a tub having a tub cover with an opening;

a drum rotatably disposed inside the tub;

a door configured to cover the opening in the tub cover when the door is closed;

a seal positioned in a gap between the door and the tub cover;

a discharge member coupled to the tub cover to discharge air in the drum to the outside of the tub to reduce air pressure in the tub based on an air seal, based on the seal being in contact with the door and the tub cover; and a cap coupled to the discharge member to inhibit water in the drum from being discharged to the outside of the tub through the discharge member, wherein the discharge member comprises an outer rib and an inner rib protruding upward from a bottom of the discharge member, the outer rib forming an outer appearance of the discharge member, the inner rib disposed inside the outer rib and forming a discharge hole communicating with the drum, and the discharge member further comprises a drain hole disposed in the radial direction of the discharge hole from the discharge hole at the bottom of the discharge member to discharge water introduced into the discharge member to the drum, wherein the cap is configured to have a gap between the discharge member, the gap forming a flow path of the air from the discharge hole to outside of the cap and the discharge member.

2. The washing machine according to claim 1, wherein the tub comprises a tub body having an open upper portion coupled to the tub cover including the opening, and the tub cover includes the door configured to cover the open upper portion of the tub body, and the discharge member is disposed in the tub cover.

3. The washing machine according to claim 2, wherein the door is configured to open or close a laundry inlet, and the discharge member is disposed in the tub cover behind the door to be adjacent to a center of the drum.

4. The washing machine according to claim 1, wherein the discharge member further comprises a middle rib disposed between the outer rib and the inner rib.

5. The washing machine according to claim 4, wherein a cross-section area of the discharge hole is smaller than a cross-section area of a first space provided between the inner rib and the middle rib.

6. The washing machine according to claim 1, wherein the drain hole is disposed between the inner rib and the middle rib.

7. The washing machine according to claim 6, wherein the middle rib is cut off to form a slot through which water introduced into a second space formed between the middle rib and the outer rib is discharged to the drain hole.

8. The washing machine according to claim 1, wherein the cap comprises an outer wall forming an outer appearance of the cap and an inner wall disposed inside the outer wall.

9. The washing machine according to claim 8, wherein a length of the inner wall protruding downward from an upper surface of the cap is longer than a length of the outer wall protruding downward from the upper surface of the cap.

10. The washing machine according to claim 8, wherein the inner wall comprises a first inner wall protruding downward from an upper surface of the cap and a second inner wall extending downward from the first inner wall to be in contact with a bottom of the discharge member.

11. The washing machine according to claim 8, wherein the cap further comprises an air hole disposed between the outer wall and the inner wall.

12. The washing machine according to claim 1, further comprising a cover member disposed on a bottom of the discharge member to prevent water from being directly discharged from the drum to the discharge hole.

* * * * *